US010132072B2

(12) United States Patent
Sinai

(10) Patent No.: US 10,132,072 B2
(45) Date of Patent: Nov. 20, 2018

(54) INSULATED STRUCTURE AND A METHOD OF ITS MANUFACTURE

(71) Applicant: Hanoch Sinai, Lehavim (IL)

(72) Inventor: Hanoch Sinai, Lehavim (IL)

( * ) Notice: Subject to any disclaimer, the term of this patent is extended or adjusted under 35 U.S.C. 154(b) by 495 days.

(21) Appl. No.: 14/807,300

(22) Filed: Jul. 23, 2015

(65) Prior Publication Data

US 2015/0322682 A1 Nov. 12, 2015

Related U.S. Application Data

(63) Continuation-in-part of application No. PCT/IL2013/051034, filed on Dec. 18, 2013.

(30) Foreign Application Priority Data

Jan. 24, 2013 (IL) ..... 224391

(51) Int. Cl.

| | |
|---|---|
| ***E04B 1/02*** | (2006.01) |
| ***E04G 11/02*** | (2006.01) |
| ***E04B 1/16*** | (2006.01) |
| *E04B 2/84* | (2006.01) |

(52) U.S. Cl.

CPC ..... *E04B 1/02* (2013.01); *E04B 1/161* (2013.01); *E04G 11/02* (2013.01); *E04B 2/845* (2013.01); *E04B 2/847* (2013.01)

(58) Field of Classification Search

CPC . E04B 1/02; E04B 1/161; E04B 2/845; E04B 2/847; E04G 11/02

See application file for complete search history.

(56) References Cited

U.S. PATENT DOCUMENTS

| | | | | |
|---|---|---|---|---|
| 1,705,028 | A | 3/1929 | Piatt | |
| 2,815,656 | A * | 12/1957 | Klein | E01F 8/0023 52/169.1 |
| 4,489,528 | A | 12/1984 | Tolliver | |
| D483,246 | S * | 12/2003 | McPherson | D8/354 |
| 7,856,778 | B2 * | 12/2010 | Pantelides | B32B 17/04 52/223.6 |
| 2003/0097812 | A1 * | 5/2003 | Molina | E04G 11/10 52/742.1 |
| 2004/0045252 | A1 * | 3/2004 | Nanayakkara | E04B 1/165 52/846 |
| 2011/0036046 | A1 * | 2/2011 | Henriquez | E04B 1/161 52/764 |
| 2012/0180411 | A1 * | 7/2012 | Trimmer | E04C 2/044 52/220.1 |

* cited by examiner

*Primary Examiner* — Monica A Huson
*Assistant Examiner* — Kelsey C Grace
(74) *Attorney, Agent, or Firm* — Roach, Brown, McCarthy & Gruber, P.C.; Kevin D. McCarthy

(57) ABSTRACT

The invention relates to a structure comprising inner and outer skeletons, each defining a cage-like structure consisting of metal structural elements, where the inner skeleton is housed within the inner space defined by the outer skeleton, and where the inner and outer skeleton are connected at one or more locations.

20 Claims, 8 Drawing Sheets

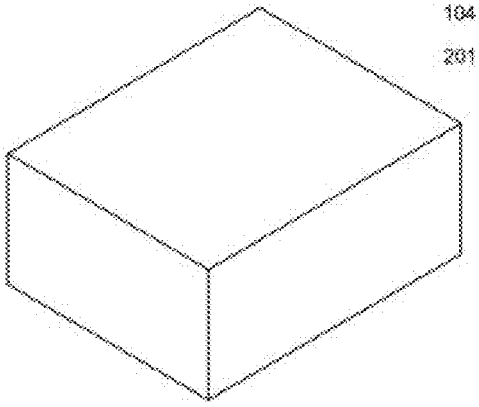
Fig. 3A
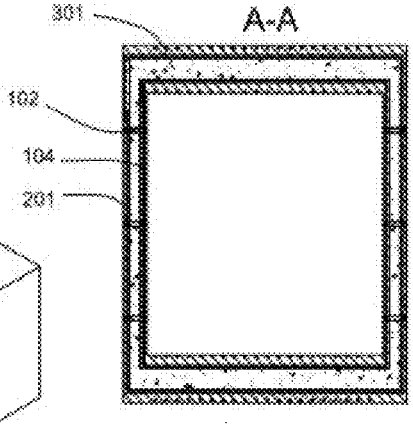
Fig. 3B
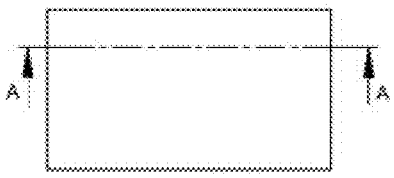
Fig. 3C
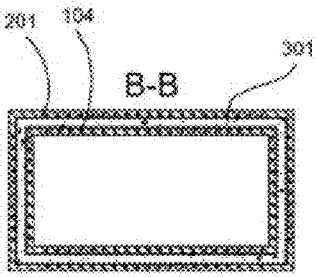
Fig. 3D
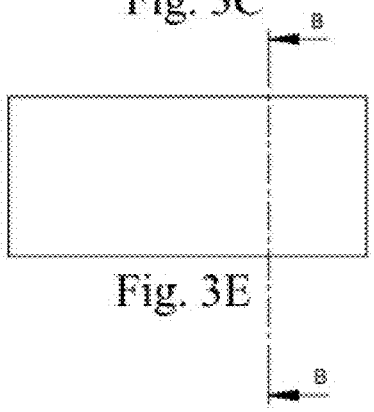
Fig. 3E
Fig. 3

INSULATED STRUCTURE AND A METHOD OF ITS MANUFACTURE

FIELD OF THE INVENTION

The present invention relates to the field of civil engineering. More particularly, the invention relates to a structure and the method of manufacturing said structure, provided with isolation, transportability and structural stability.

BACKGROUND OF THE INVENTION

In civil engineering, there are many important factors taken under consideration such as safety, cost and the duration of the process. For a structure to be safe, it has to be provided with a strong skeleton, usually made of metal parts along the walls. The skeleton needs to be surrounded by a strong casting material such as concrete. The cost of the process is mostly affected by the materials, the duration of the process and the number of employees needed to complete it.

Nowadays, structures made of concrete are constructed from several different parts. After the foundations are in place, the floor can be built. When the floor is made of concrete, there has to be a floor pattern into which the concrete is casted. After casting, the concrete needs to set and become solidified, taking days or even weeks. Construction of the wall can be initiated only when the floor is solid. The construction of the wall involves the use of reinforcement rods and concrete casting. The rods contribute to the stability of the wall and in combination with the concrete, form a strong wall. After another period of time, in which the concrete reaches its solid state, it is possible to start building the ceiling.

The process is laborious, multistep and time-consuming. It is therefore clear that it would be highly desirable to be able to provide a structure that can be created in a limited number of concrete casts, preferably in one cast, thereby substantially streamlining the process and reducing costs. However, to date, the prior art has failed to provide an efficient structure or method for its manufacture, for producing an isolated and portable structure, while using a minimum number of employees and producing an essentially finished structure, all in one step, without long waiting periods between the various stages.

It is an object of the present invention to provide a structure and method that overcome the drawbacks of the prior art, particularly on aspects related to safety, cost and the duration of the process.

It is another object of the invention to provide a structure created by a single concrete casting into a pre-prepared double envelope.

It is yet another object of the invention to provide an efficient method in which a monolithic structure can be created, which can be easily moved from one location to another.

Other objects and advantages of the invention will become apparent as the description proceeds.

SUMMARY OF THE INVENTION

The invention relates to a structure comprising inner and outer skeletons, each defining a cage-like structure consisting of metal structural elements, wherein the inner skeleton is housed within the inner space defined by the outer skeleton, and wherein the inner and outer skeleton are connected at one or more locations. The inner and outer skeletons are made of metal rods that are attached to surrounding beams, by passing through connecting points found on the surrounding beams. There are covering boards in the form of surfaces, suitable for delimitation of concrete casting. The covering boards can be removable, reusable or an integral part of the final structure. The inner covering board of the outer skeleton and the outer covering board of the inner skeleton are at a distance from each other, and form a space between them, which is suitable to serve as a passage for electrical wires and pipes, or as an insulation material storage space.

The inner skeleton in its post-casting state, form an inner structure, and the outer skeleton in its post-casting state, form an outer structure. The structural position of the inner structure is located inside the outer structure and the supporting means are parts connected to both inner and outer structures or to both skeletons of inner and outer structures. The structure is transportable and can be of various sizes up to a building.

The structure comprises spaced inner and outer skeletons, each defining a cage-like structure, wherein each of said inner and skeletons comprises a plurality of metal reinforcing rods, a sequence of which on a same plane defines a face of said cage-like structure, and at least two surrounding beams that surround faces of said cage-like structure.

Said plurality of metal rods are received in said at least two surrounding beams, such that those rods that are received in an inner side of said at least two surrounding beams form said inner skeleton, and those rods that are received in an outer side of said at least two surrounding beams form said outer skeleton. Each of said at least two surrounding beams is configured with a plurality of rod receiving protrusions and with an interspace between each pair of said protrusions through which concrete is flowable from one side of said at least two surrounding beams to a second side thereof, when casted into a space associated with said structure.

The invention also relates to a method for manufacturing a structure, comprising providing inner and outer skeletons, each defining a cage-like structure consisting of metal structural elements, wherein the inner skeleton is housed within the inner space defined by the outer skeleton, and wherein the inner and outer skeleton are connected at one or more locations, and casting concrete in a space that comprises said inner and outer skeletons. The casting can be carried out in one step.

BRIEF DESCRIPTION OF THE DRAWINGS

In the drawings:

FIG. 3 (A-E) illustrates a structure according to one embodiment of the invention, which utilizes the inner skeleton of FIG. 1 and the outer skeleton of FIG. 2. FIG. 3B is a horizontal cross-sectional A-A view and FIG. 3D is a vertical cross-sectional B-B view of a structure, according to one embodiment of the invention;

DETAILED DESCRIPTION OF THE INVENTION

The invention provides a structure by which a reinforced enclosure is able to be speedily constructed and a method for its manufacture. The structure of the invention is isolated, portable and built efficiently. The structure is made of two parallel surfaces on each side that are made of concrete and metal materials. Those parallel surfaces are built around inner and outer skeletons, and are able to form the walls, the floor and the ceiling of the enclosure. The space between each two parallel surfaces provides isolation, and is utilized for the passage of pipes or electrical wires, and for any other connections that are necessary for the resulting structure to be functional, such as, for example, Internet or TV optical cables, and the like. Suitable connectors are provided in the walls for connecting to outside sources, such as electricity, telephone, air conditioning, etc., and therefore all required piping, tubing and connectors are preferably positioned within the skeleton prior to concrete casting.

Figure 1:
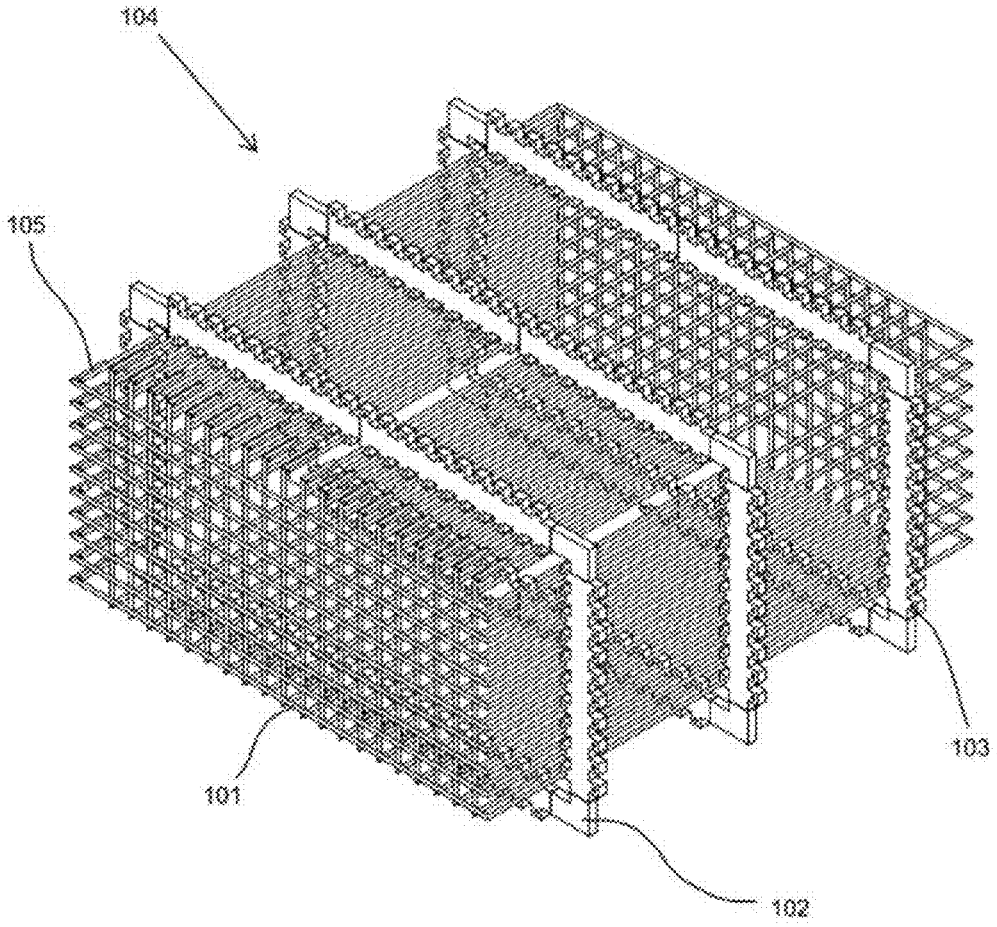
FIG. 1 is a perspective view of the inner skeleton of a structure according to one embodiment of the invention.
Figure 2:
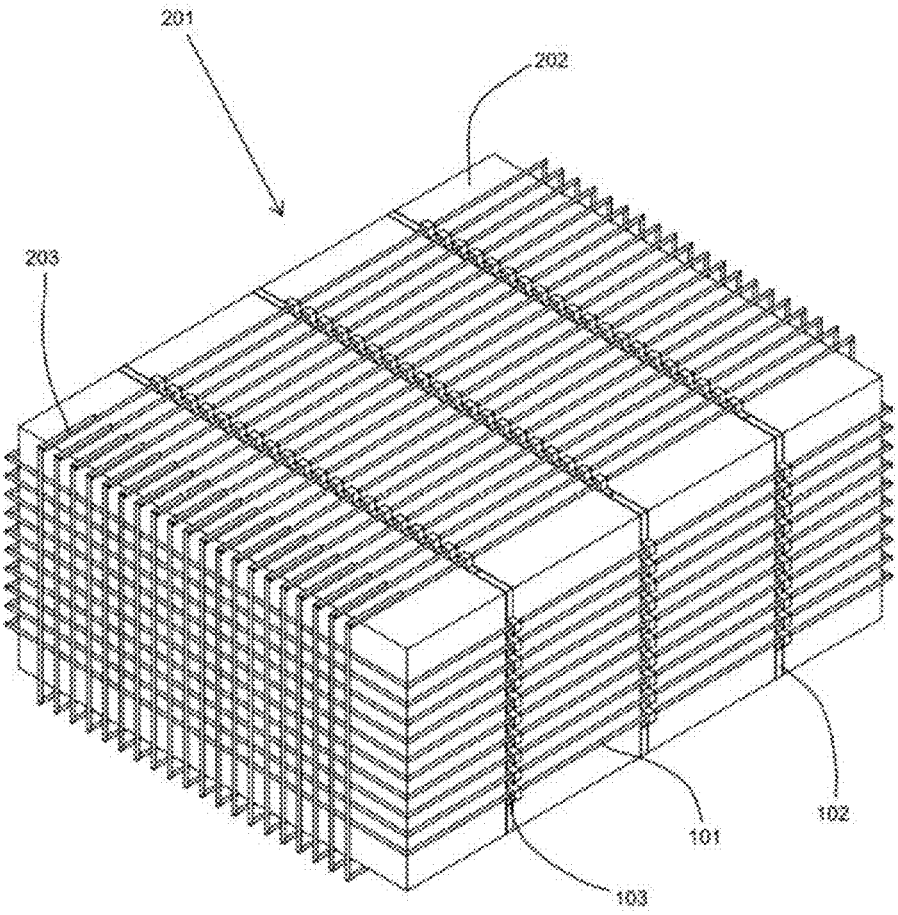
FIG. 2 is a perspective view of the outer skeleton which is used together with the inner skeleton of FIG. 1.

FIGS. 1 and 2 are pre-casting perspective views of the inner and outer skeletons. FIG. 1 is a view of the inner skeleton 104 comprising a plurality of metal reinforcing rods 101 that are held by surrounding beams 102 at corresponding receiving cavities 103, and FIG. 2 is a view of an outer skeleton 201, also comprising metal rods 101 that are held by surrounding beams 102 at corresponding receiving cavities 103, and a covering board 202. A covering board 202 delimiting passage of the poured concrete may be positioned at a distance from the rods 101, with respect to both inner skeleton 104 and outer skeleton 201, in such way that the rods 101 are in the casting space.

Surrounding beam 102 provides both a supporting vertical element and horizontal supporting structural elements that prevent the ceiling from caving in under its weight. Additionally, surrounding beams 102 can be provided, at least at some locations, with eyelets or other well known means for facilitating a lifting operation that can be used by lifting equipment to displace the completed structure, so as to lift it and move it to a different location.

An additional advantage of surrounding beams 102 is that they allow building relatively large structures without the need for additional supporting elements, such as descending beams or pillars.

FIG. 3 shows post-casting views. FIG. 3A is a perspective view of a finished structure according to one embodiment of the invention. FIG. 3B is a horizontal cross-sectional A-A view of FIG. 3C, in which the inner skeleton 104 and the outer skeleton 201 are both held by surrounding beams 102. The space between inner skeleton 104 and outer skeleton 201 may be filled with an insulation layer 301, which can serve the dual purpose of providing acoustic and thermal insulation, or only one of them, depending on the insulation material employed. A suitable material, which is commonly employed in construction, is expanded polystyrene. FIG. 3D is a vertical cross-sectional B-B view of FIG. 3E, in which the inner skeleton 104 and the outer skeleton 201 are separated by the insulation layer 301.

Figure 4:
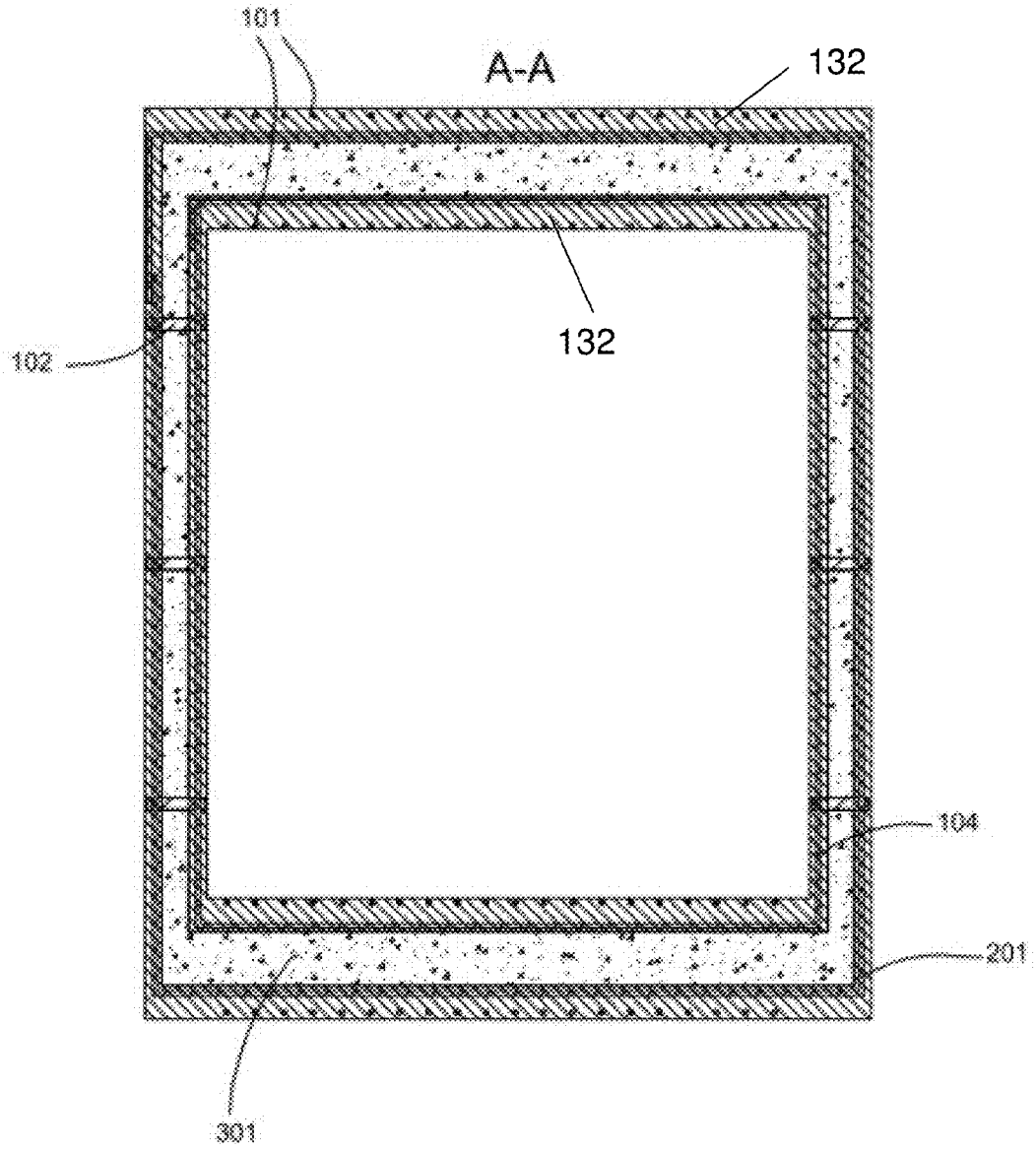
FIG. 4 shows the horizontal cross-sectional A-A view on an enlarged scale.
Figure 5:
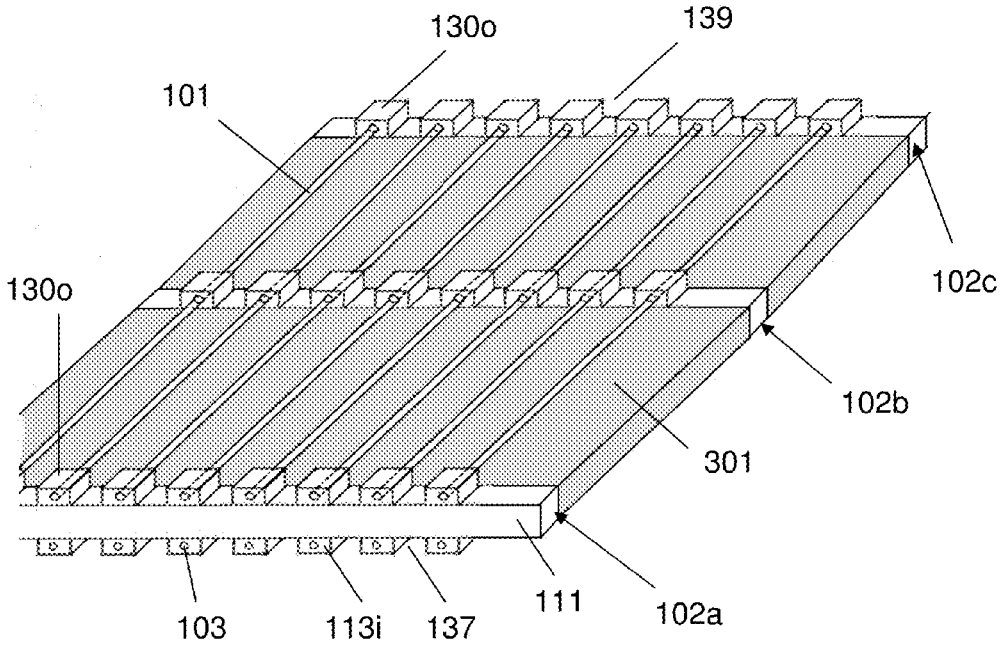
FIG. 5 is a perspective view from the top of a portion of a structure, showing three spaced surrounding beams, a plurality of metallic rods received in corresponding aligned arrangements of cavities associated with the surrounding beams, and an insulating element received in a space between the inner and outer skeletons.

FIG. 4 is an enlarged image of the horizontal cross-sectional A-A view of a structure manufactured according to one embodiment of the invention, in which the rods 101 are embedded within hardened concrete 132 provided for both inner skeleton 104 and outer skeleton 201. This view illustrates the final structural position wherein the inner structure is located inside the outer structure and the surrounding beams 102 are connecting them to each other.

The construction process is performed as follows: inner skeleton 104 (see FIG. 1) is first prepared, to define the inner space of the enclosure to be constructed. A covering board, which may be in the form of a three-dimensional formwork element, is secured to each inner surface of the inner skeleton 104. Once the inner skeleton is completed, construction of the outer skeleton is initiated around the inner skeleton. It is desired that matching faces or surfaces of the inner and outer skeletons be essentially parallel to one another.

Since the outer and inner skeletons essentially define each a cage, and because of the importance of structural strength of the skeleton, it is desired to provide for good connection between vertical and horizontal beams and metal parts, so as to achieve a rigid cage-like structure, as illustrated by 105 in FIG. 1 and by 203 in FIG. 2. The connection can be of any suitable type, e.g. welding, connecting element or any other type of connection known to persons skilled in the art.

Once the cage-within-cage structure is completed the inner skeleton and the outer skeleton are connected at a plurality of locations, using connecting elements, which are typically metal elements, but which can be made of any other suitable construction material.

One particularly convenient structure to achieve the connection between the two skeletons is that illustrated in the exemplary structure of the figures, which employs surrounding beams 102 and which can be of any desired shape. A particular example of a rectangular surrounding beam 102 is shown in detail in FIGS. 1, 2, 5 and 6.

Each surrounding beam 102, which is configured to surround, and to be integrated with inner skeleton 104, comprises a main beam portion 111 and a plurality of spaced protrusions, e.g. identical and equally spaced protrusions, extending into a casting space. Protrusions 113*i* extend into the casting space of inner skeleton 104, and protrusions 113*o* extend into the casting space of outer skeleton 201, thereby allowing surrounding beam 102 to be integrated with outer skeleton 201 as well.

The surrounding beam 102, beside its own strength afforded by its relatively greater size than the metal rods used to create the skeleton, can also be provided, as in this exemplary structure, with receiving cavities 103, which can be used to create the outer skeleton by passing the rods through a corresponding cavity formed in the beams 102. When such a beam is used, surrounding beams 102 also function as spacers and therefore permits to create a structure which is highly precise. It is of course possible to provide alternative and/or additional connecting elements, to connect between the inner and the outer skeleton. The number and location of connecting elements will be dictated by strength and structural requirements specific to any particular structure.

Each of inner protrusions 113*i* and outer protrusions 113*o*, which has the illustrated rectangular cross section or any other desired shape, is configured with a corresponding receiving cavity 103. A horizontal reinforcing rod 101 is introduced into the receiving cavity 103 of aligned inner protrusions 113*i* of each surrounding beam, e.g. surrounding beams 102*a-c*, provided with inner skeleton 104, at different sides of the inner skeleton.

To complete the inner skeleton comprising five or six sides, a plurality of spaced vertical rods are welded, or otherwise connected, to the end of corresponding horizontal rods that have already been deployed, to define the longitudinal ends of the inner skeleton, as shown in FIG. 1. In addition, inserts defining an architectural element to be formed such as a window or door may be positioned within a selected skeleton side and joined to the adjacent rods of reduced size and/or to an adjacent surrounding beam.

After securing covering boards or a three-dimensional formwork element to each inner face of the inner skeleton, another three-dimensional formwork element is positioned outwardly from each outer face of the inner skeleton, at such a position that ensures that only the inner protrusions 113*i*, but not the outer protrusions 113*o*, of each surrounding beam will be covered by the poured concrete. Alternatively, the outer formwork element maintains the concrete in any desired volume that is suitable for integration with the inner skeleton. The outer formwork element, or a plurality of covering boards, may be assembled by a plurality of interconnectable sections that accommodate the configuration of the surrounding beams. One or more dedicated openings are formed in the outer formwork element, to permit concrete to be cast therethrough. The concrete used must be of sufficiently low viscosity so as to permit it to reach every location within the cage and to avoid the creation of hidden voids. One illustrative example of a concrete type suitable for this purpose is Meda 450.

As will be appreciated by the skilled person, additional void spaces may need to be provided in the structure according to the invention, e.g., to house an electric board, housings that need to be kept at or near wall surface level, such as for instance telephone switchboards, and other elements such as window and door frames and the like. One convenient way of providing those spaces is by inserting in the structure, prior to concrete pouring, rectilinear inserts in the shape of the element that it is desired to define after the structure has solidified, which can be then removed. Such hollow inserts are typically filled with hard material to prevent them from being deformed during the pouring of concrete. The inserts are removed once the structure has solidified, thereby leaving empty spaces that can be used to house the desired final element into the structure.

Following the pouring and setting of concrete, a plurality of rods 101 extending the entire length of the skeleton become integrated with each surrounding beam 102, to produce a structure of high strength in both tension and compression. Advantageously, the concrete layer at the outer surface of the inner skeleton has a uniform thickness and is spread to its edges, by virtue of the interspaces 137 that are formed between adjacent inner protrusions 113*i* and that permit the poured concrete to freely flow past each surrounding beam to the edges of the outer surface.

The outer skeleton 201 is then prepared by introducing a horizontal reinforcing rod 101 into the receiving cavity 103 of aligned outer protrusions 1130 of each surrounding beam, e.g. surrounding beams 102*a-c*, at different sides of the outer skeleton.

The provision of longitudinally spaced surrounding beams each having doubly sided protrusions facilitates the construction of an outer skeleton 201 that is essentially isolated from inner skeleton 104, by means of the interspaces that are formed between all sides of the outer skeleton and the inner skeleton. A layer of insulating material 301 may then be introduced within each isolating interspace, between the hardened outer surface of the inner skeleton and the reinforcing rods of the outer skeleton. Although it may be loosely introduced within the corresponding isolating interspace, insulating material 301 becomes sandwiched between, and irremovable from, the concrete layers of the inner and outer skeletons, respectively, after concrete is poured onto, and becomes integrated with, the reinforcing rods of the outer skeleton.

Prior to pouring concrete onto the outer skeleton, additional covering boards or formwork elements are positioned outwardly from each outer face of the outer skeleton. The outer formwork element, or a plurality of covering boards, may be assembled from a plurality of interconnectable sections. One or more dedicated openings are formed in the additional formwork element, to permit concrete to be cast therethrough. The poured concrete covers the outer protrusions 113*i* of each surrounding beam by a layer that has a uniform thickness and is spread to its edges, by virtue of the interspaces 139 that are formed between adjacent outer protrusions 113*o* and that permit the poured concrete to freely flow past each surrounding beam to the edges of the outer surface.

Alternatively, concrete may be poured simultaneously onto both the inner and outer skeletons by employing two sets of formwork elements, such that a first set is positioned internally to a second set and that each set is formed with a different opening for the introduction therethrough of concrete.

Figure 6:
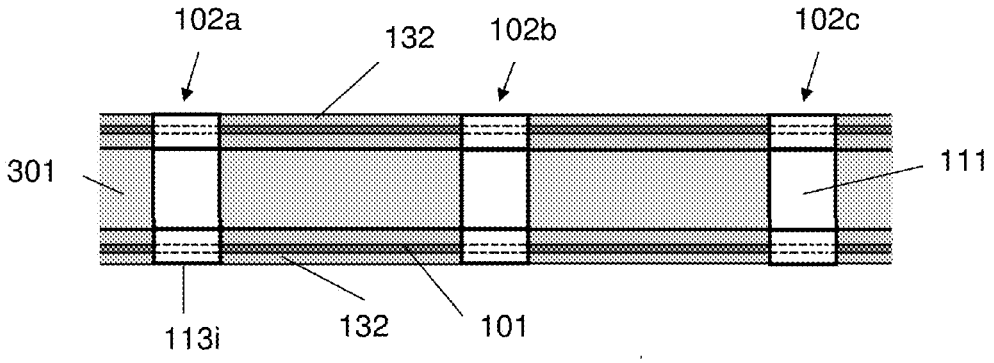
FIG. 6 is a side view of the structure portion of FIG. 5.

The completed structure partially illustrated in FIG. 6, which comprises separated, rod-embedded outer and inner layers of concrete 132 that are both integrated with a plurality of spaced surrounding beams is of significantly lower weight than prior art structures of similar dimensions, yet is of surprisingly high strength by virtue of the integration in parallel of the rods with a plurality of surrounding beams. The lower weight naturally contributes to reduced stress concentrations to be formed in the structure, particularly at lower floors thereof.

In the fashion described above, a structurally strong and insulated three-dimensional enclosure can be speedily produced and then transported to a construction site.

In other embodiments of the invention, different structures are able to be constructed by employing a U-shaped surrounding beam. According to these embodiments, the inner and outer skeletons are not completely filled with concrete, but rather only part of the skeleton is filled, so as to create a structure that is open at its top.

Figure 7:
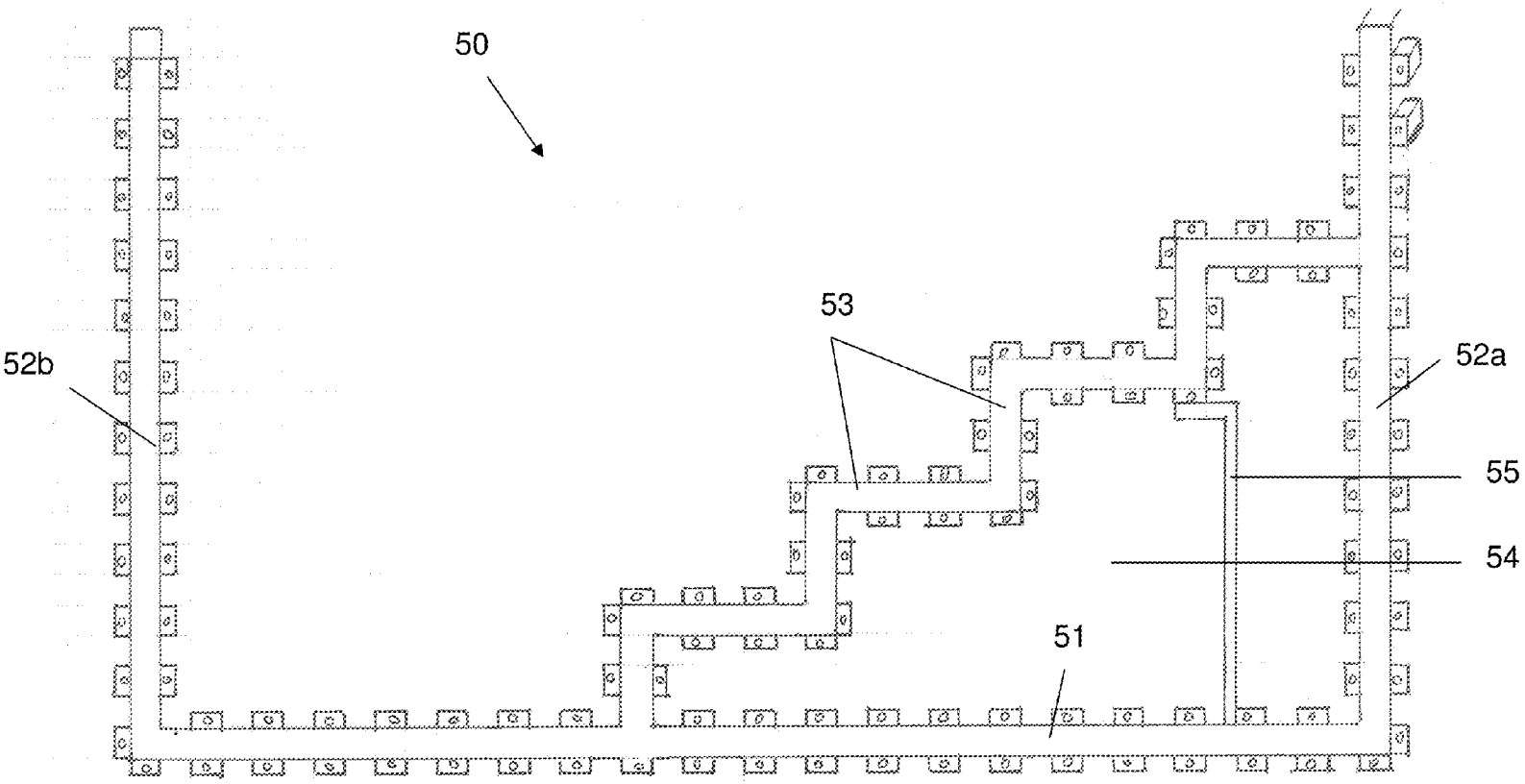
FIG. 7 is a side view of a structure used to construct a swimming pool.

Structure 50 illustrated in FIG. 7 is used to construct a swimming pool, or any other structure that is open at its top. Structure 50 comprises a plurality of surrounding beam segments which are connected to each other to form the U-shaped configuration. In the example of a swimming pool, the horizontal segment 51 of the surrounding beam serves for constructing the pool's floor, while the vertical segments 52*a* and 52*b* are used for constructing the pool's surrounding walls. It is also possible to connect a combination of horizontal and vertical segments for constructing a set of stairs 53, inclined elements, or other types of levels at different heights. Of course, the upper portion of the concrete structure can then be covered with tiles or other finishing elements.

According to another embodiment, the combination of horizontal and vertical segments for constructing stairs 53 may be single sided and the cavity 54 formed therebelow may be empty. Cavity 54 is suitable to house equipment for operating the swimming pool, such as motors, chlorinating apparatus, and electric equipment for lighting purposes. Alternatively, cavity 54 may be filled with an insulating material such as polyurethane, which supports the concrete inserted therein. Alternatively, molds may be used to support the concrete while pouring the concrete. An inverted L-shaped support element 55 may be attached to the underside of one or more segments of the set of stairs 53.

Figure 8:
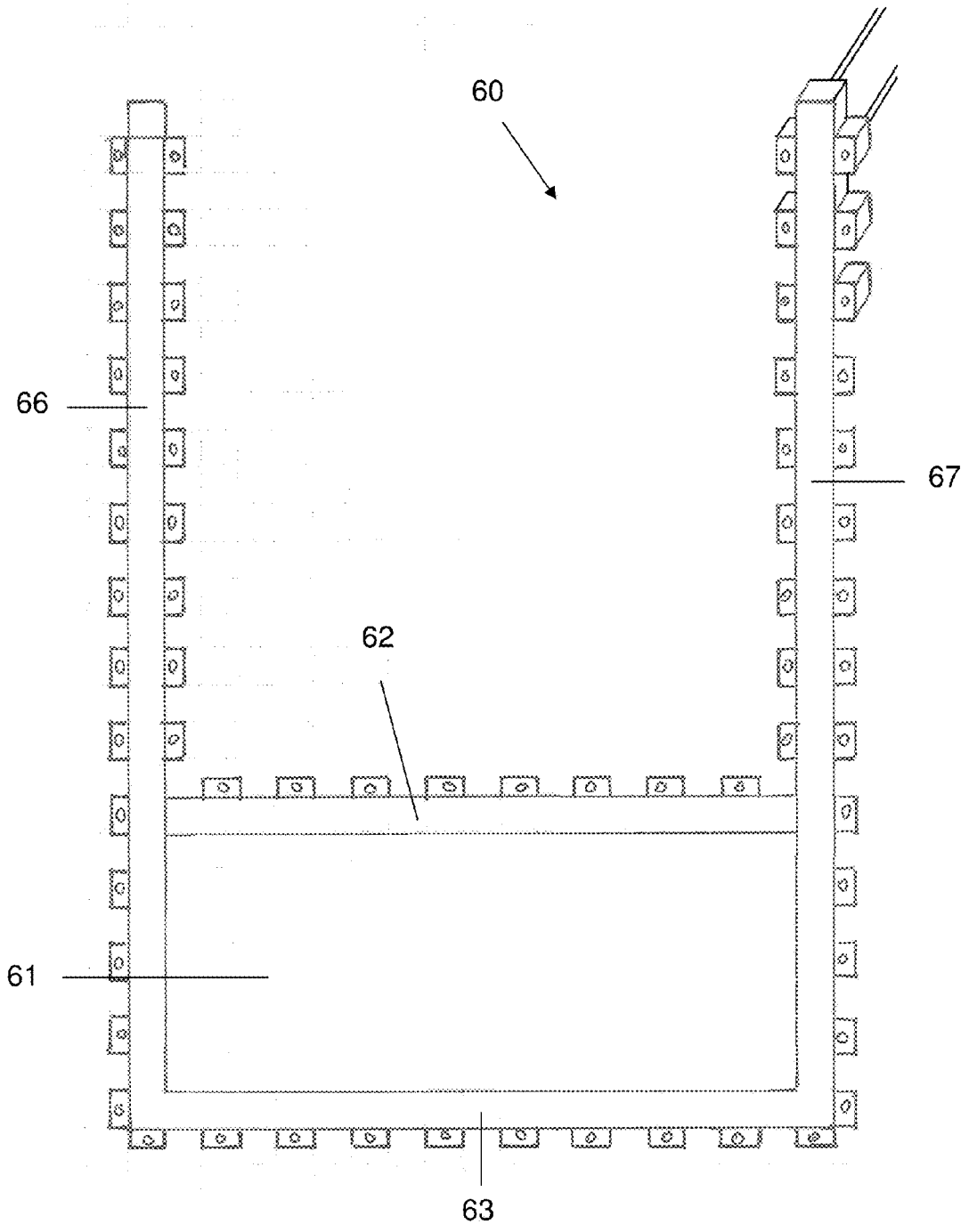
FIG. 8 is a side view of a structure constructed from a U-shaped configuration.

FIG. 8 illustrates a structure 60 comprising a plurality of surrounding beam segments which are interconnected to form a U-shaped configuration suitable for constructing open or semi-open structures along with an internal space 61, which may serve as a gallery or a storeroom. In this embodiment, the horizontal beam 62 defining internal space 61 therebelow may be single sided, as illustrated, wherein the cavity bearing protrusions into which a corresponding rod is insertable all extend upwardly from beam 62.

It will be appreciated that a beam configured with cavity bearing protrusions in conjunction with any other embodiment described herein may also be single sided.

Structure 60 may be advantageously used to construct multi-story buildings. Columns or uprights 66 and 67 defining the legs of the U-shaped structure extend upwardly from bottom beam 63, which is preferably double sided and adapted to define the floor of the building, to an uppermost beam (not shown) defining the ceiling of the building. In this embodiment, a horizontal beam 62, preferably double sided, is provided at each floor of the building to be constructed in accordance with the method of the invention, i.e. with a plurality of rods that are each introduced into aligned receiving cavities of different beams and then integrated with the poured concrete.

A formwork element is inserted within internal space 61, and also each of the columns 66 and 67 and bottom beam 63 are provided with formwork elements. Concrete is poured into the volume defined by the formwork elements, until a height corresponding to approximately the location of the first floor beam 62, so as to limit the weight of columns 66 and 67 as well as the resulting stress within the columns. After the poured concrete has set and hardened, the formwork elements are removed to define a room or a general open volume of the first floor. This procedure is sequentially repeated for each floor, so that the height of the columns will gradually increase while restricting the moment that is acting on them by producing a structurally strong floor/ceiling extending between the two columns and that may be provided with a layer of insulating material.

Figure 9:
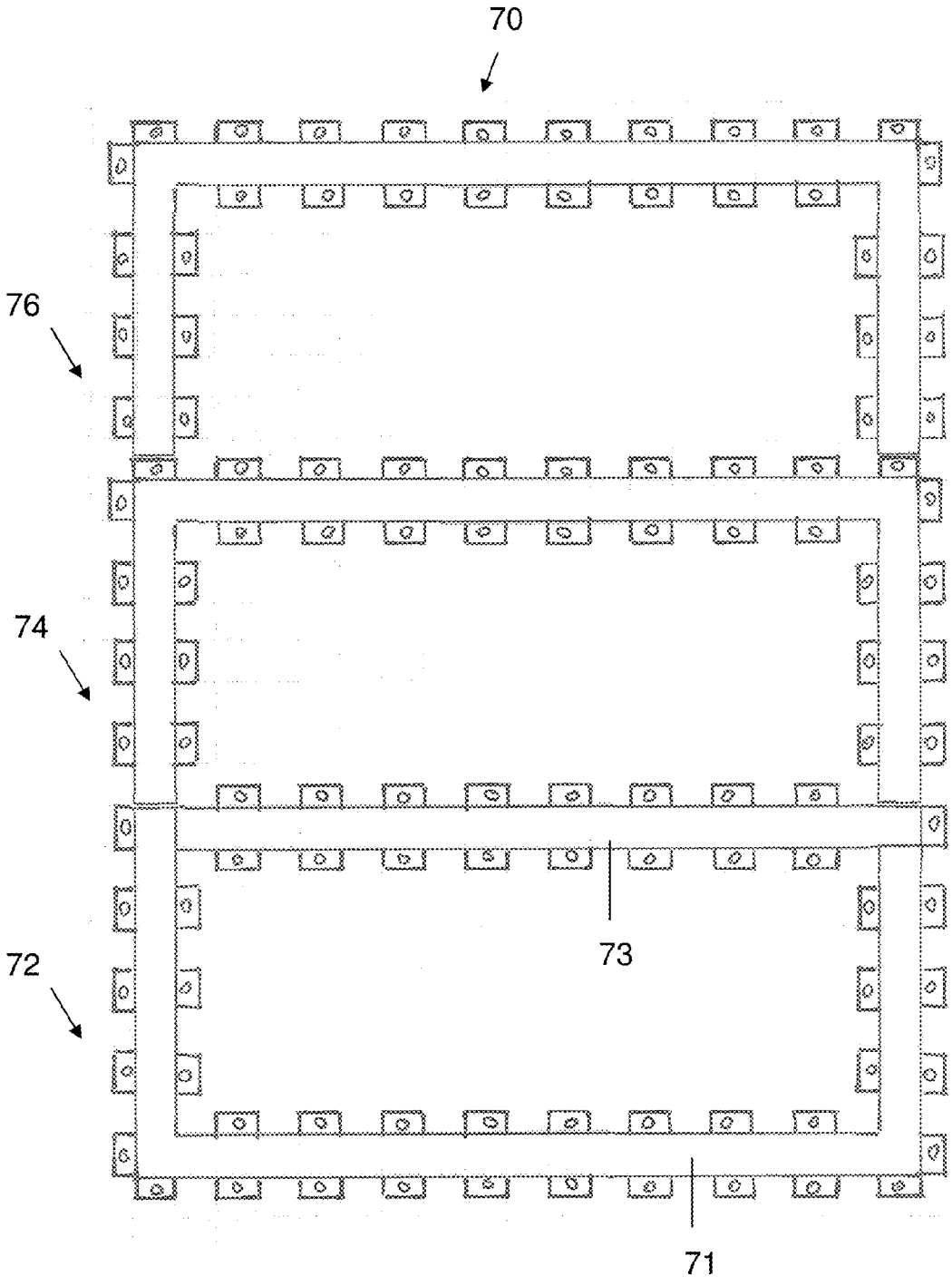
FIG. 9 is a side view of a composite multi-story structure.

FIG. 9 illustrates a composite multi-story structure 70 comprising a plurality of separate and joinable prefabricated structure units 72, 74 and 76. To considerably save construction and assembly time, structure units 72, 74 and 76 may be simultaneously fabricated at a factory according to the method described above and then transported to the construction site.

Lower structure unit 72 is of cube-like construction with lower and upper double-sided beams 71 and 73, respectively. Lower structure unit 72 is joined to the concrete foundation of the building or to any other suitable construction element by reinforcement, connecting elements such as a moment connection, casting, or a combination thereof, allowing the concrete enhanced lower beam 71 to serve as the ground floor of the building. Structure unit 74 of U-shaped configuration is then lowered while its closed base is upwardly oriented onto structure unit 72. Thus concrete enhanced upper beam 73 of lower structure unit 72 serves as the floor of structure unit 74 as well as the ceiling of structure unit 72. This process is repeated for every additional floor, to quickly construct the building.

Although the above description has been given with reference to the pumping and/or pouring of concrete into the structure, different ways to create the concrete structure exist, which can be used within the scope of the invention. An example of an alternative construction method, suitable to create the final concrete structure, is the spraying of concrete material upon the cages, so as to create a plurality of layers of concrete, until the whole structure is created. Of course, the first layer has to be sprayed against a bordering surface as may be, for instance, a layer of expanded polystyrene.

All the above description has been provided for the purpose of illustration and is not meant to limit the invention in any way. The invention presents significant advantages over the existing art. For example, the single casting operation for the whole structure that saves time, that otherwise would have been inefficiently utilized during waiting periods between the casting of each surface.

The invention claimed is:

1. A structure, comprising spaced inner and outer skeletons, each defining a cage-like structure, wherein each of said inner and outer skeletons comprises a plurality of metal reinforcing rods, a sequence of which on a same plane defines a face of said cage-like structure, and at least two longitudinally spaced surrounding beams that surround the faces of said inner skeleton and that are surrounded by the faces of said outer skeleton, wherein all of said plurality of metal rods are received in said at least two surrounding beams, such that those rods that are received in an inner side of said at least two surrounding beams form said inner skeleton, and those rods that are received in an outer side of said at least two surrounding beams form said outer skeleton, wherein each of said at least two surrounding beams is configured with a main thickened portion, a plurality of laterally spaced and doubly sided rod receiving protrusions arranged such that inner and outer sides of each of said doubly sided protrusions extend from said main portion into two opposing casting spaces, respectively, and an interspace between each adjacent pair of said inner sides and of said outer sides through which a uniform thickness of concrete is flowable from one longitudinal end of said inner or outer skeleton at least two surrounding beams to a second longitudinal end thereof, when casted into a corresponding casting space.

2. The structure according to claim 1, wherein the rods are attached to the surrounding beams by passing through connecting points found on the surrounding beams.

3. The structure according to claim 1, further comprising covering boards, which are surfaces suitable for delimitation of concrete casting.

4. The structure according to claim 3, wherein the covering boards are removable or reusable.

5. The structure according to claim 3, wherein the covering boards are an integral part of a final structure.

6. The structure according to claim 3, wherein an inner covering board of the outer skeleton and an outer covering board of the inner skeleton are at a distance from each other, and form an isolating space between them, the isolating space being suitable to serve as a passage for electrical wires, a passage for pipes or an insulation material storage space.

7. The structure according to claim 1, wherein the inner skeleton in a post-casting state, form an inner structure, and the outer skeleton in a post-casting state, form an outer structure.

8. The structure according to claim 7, wherein a structural position of the inner structure is located inside the outer structure.

9. The structure according to claim 1, wherein the structure is transportable.

10. The structure according to claim 1, which is a building.

11. A constructed building structure, comprising:

a) a plurality of longitudinally spaced, identical and aligned structural elements, each of said structural elements configured with a main thickened portion and with a plurality of laterally spaced and doubly ended protrusions arranged such that inner and outer protruding ends of each of said doubly ended protrusions extend from said main portion into two opposing casting spaces, respectively, wherein each of said inner and outer protruding ends is formed with a receiving through-hole;

b) a plurality of reinforcing rods significantly thinner than a width of said structural element main portion, some of said reinforcing rods extending through a set of aligned receiving through-holes formed in a corresponding inner protruding end of each of said structural elements to define an inner skeleton and some of said reinforcing rods extending through a set of aligned receiving through-holes formed in a corresponding outer protruding end of each of said structural elements to define an outer skeleton;

c) an inner layer of concrete integrated with an entire length of each of said rods of said inner skeleton and with each of said structural elements, and an outer layer of concrete integrated with an entire length of each of said rods of said outer skeleton and with each of said structural elements, wherein said inner layer is isolated from said outer layer; and d) an irremovable layer of insulating material filled in within an interspace defined between said inner and outer layers of concrete.

12. The structure according to claim 11, wherein the layer of insulating material has a thickness that is no greater than the width of the main portion of each of the structural elements.

13. The structure according to claim 11, wherein each of the structural elements is a surrounding beam that is configured with a plurality of angularly different portions arranged in such a way so as to surround at least a portion of the inner skeleton and to be surrounded by at least a portion of the outer skeleton.

14. The structure according to claim 13, wherein ends of angularly different reinforcing rods are welded together.

15. The structure according to claim 13, wherein the surrounding beam is U-shaped such that the inner and outer skeletons are incompletely filled with concrete, to facilitate construction of an upwardly open structure.

16. The structure according to claim 15, which is a swimming pool, wherein a lowermost horizontal segment of the surrounding beam constitutes a floor of the swimming pool, vertical segments of the surrounding beam constitute surrounding walls of the swimming pool, and a combination of horizontal and vertical segments are used for constructing a set of stairs of the swimming pool.

17. The structure according to claim 15, which is used to construct one story of a multi-story building.

18. The structure according to claim 13, wherein one or more of the surrounding beams is configured with at least one eyelet for facilitating a lifting operation in cooperation with an elongated element interconnect able with lifting equipment.

19. The structure according to claim 11, wherein each of the inner and outer layers of concrete has a uniform thickness.

20. The structure according to claim 19, wherein the rods of the inner skeleton are positioned at a centerline of the inner layer and the rods of the outer skeleton are positioned at a centerline of the outer layer.

* * * * *